US006452370B1

(12) United States Patent
Frank

(10) Patent No.: US 6,452,370 B1
(45) Date of Patent: Sep. 17, 2002

(54) LOW NOISE BIASING TECHNIQUE

(75) Inventor: Michael L. Frank, Los Gatos, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 61 days.

(21) Appl. No.: 10/010,359

(22) Filed: Nov. 13, 2001

(51) Int. Cl.[7] ..... G05F 3/16
(52) U.S. Cl. ..... 323/315; 327/537
(58) Field of Search ..... 323/312, 313, 323/314, 315; 327/534, 530, 535, 537, 540, 541, 543

(56) References Cited

U.S. PATENT DOCUMENTS 4,961,006 A * 10/1990 Pace et al. ..... 323/315 X
5,486,787 A * 1/1996 Maekawa ..... 323/315 X

* cited by examiner

*Primary Examiner*—Jessica Han
(74) *Attorney, Agent, or Firm*—Pamela Lau Kee

(57) ABSTRACT

The present invention provides gate bias to an enhancement mode field effect transistor.

4 Claims, 1 Drawing Sheet

LOW NOISE BIASING TECHNIQUE

BACKGROUND

One of the common ways to provide gate bias to an enhancement mode Field Effect Transistor (eFET) is to use a current mirror. The current mirror is itself a source of unwanted noise. In the prior art, using the largest value resistor possible to couple from the current mirror to the amplifier transistor has minimized this noise. This resistor (Ri) can cause a reduction in the power handling capacity of the amplifier transistor. When the input signal is large enough, the amplifier transistor attempts to draw more current. This action requires more current through the gate of the field effect transistor (FET), dropping voltage across Ri. As the voltage increases across Ri, the voltage available to the input of the amplifier transistor is reduced. The voltage at the input sets the current through the amplifier, and so this reduction lowers the power handling capacity of the amplifier. This is a significant source of distortion. The distortion is another noise source.

A large resistor minimizes the noise injected into the amplifier from the bias network but a small resistor minimizes the noise due to distortion. The compromise can be difficult to find.

SUMMARY

In a first embodiment, a first transistor has a drain and gate tied together at a first node. Its source is connected to ground. A current-setting resistor connects between the first node and an RF output. A first capacitor connects between node A and ground. A first inductor connects between an RF input and node A. The second transistor has a drain connected to the RF output and a source connected to ground. A second inductor connects between the gate of the second transistor and the RF input. A third inductor interposes power and the RF output. A second capacitor interposes power and ground.

In a second embodiment, a first transistor has a drain and gate tied together at node B. The source of the first transistor is connected to ground. A first capacitor connects between node B and ground. A second transistor has a drain connected to a RF output and a source connected to ground. A current setting resistor interposes power and node B. A first inductor interposes node B and a RF input. A second inductor connects between the gate of the second transistor and the RF input. A third inductor interposes power and the RF output. A second capacitor interposes power and ground.

In both embodiments, the first and second transistors are formed on a unitary substrate. The current setting resistor may be optionally integrated onto the unitary substrate.

DETAILED DESCRIPTION

Figure 1:
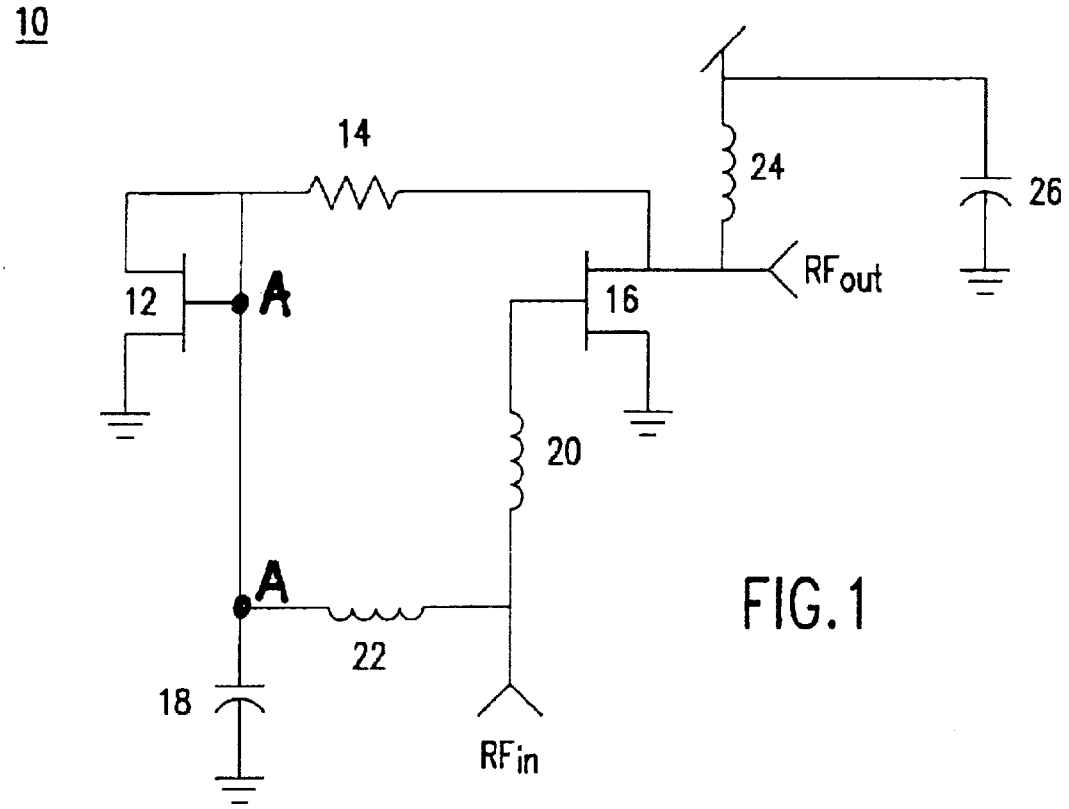
FIG. 1 illustrates a first circuit topology according to the present invention.

FIG. 1 illustrates a first circuit topology 10 according to the present invention. A first transistor 12 has a drain and gate tied together at a first node A. Its source is connected to ground. A current-setting resistor 14 connects between the first node A and an RF output. A first capacitor 18 connects between node A and ground. A first inductor 22 connects between an RF input and node A. The second transistor 16 has a drain connected to the RF output and a source connected to ground. A second inductor 20 connects between the gate of the second transistor and the RF input. A third inductor 24 interposes power and the RF output. A second capacitor 26 interposes power and ground.

The first and second transistors 12, 16 are formed on a unitary substrate (not shown). The current-setting resistor 14 may be optionally integrated onto the unitary substrate.

Figure 2:
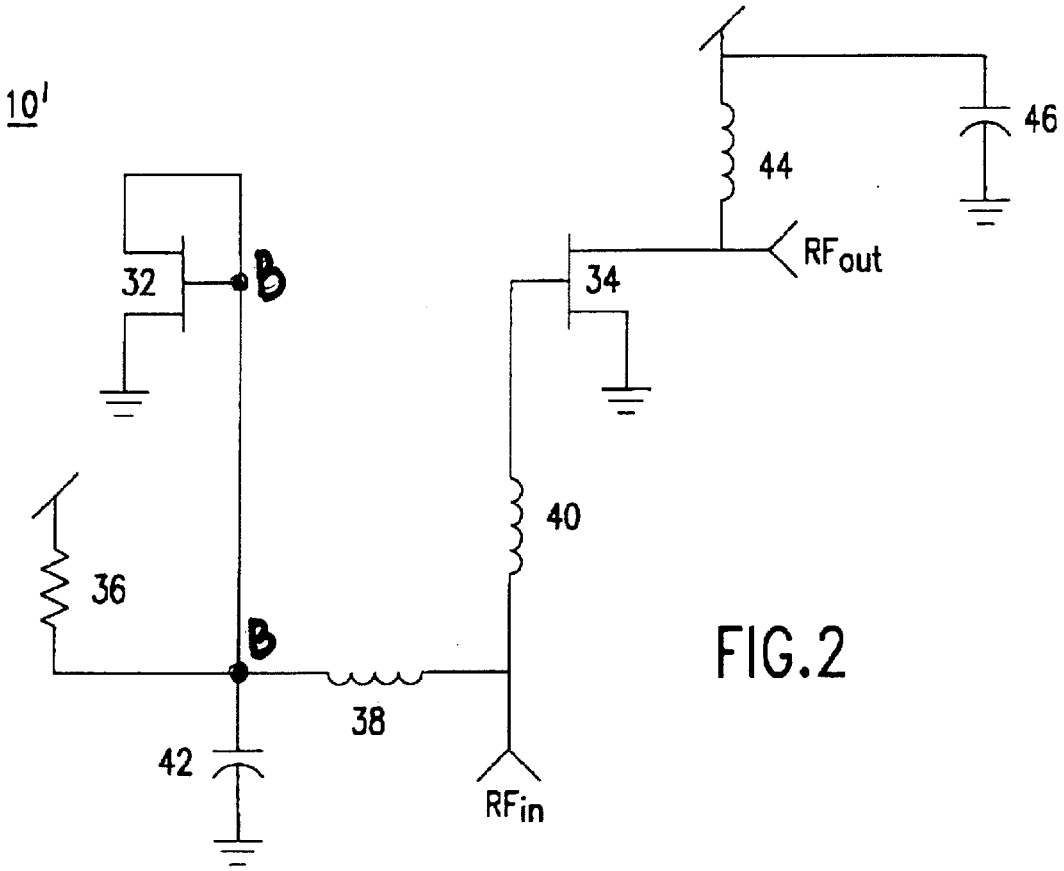
FIG. 2 illustrates a second circuit topology according to the present invention.

FIG. 2 illustrates an alternate embodiment 10' of the present invention. A first transistor 32 has a drain and gate tied together at node B. The source of the first transistor 32 is connected to ground. A first capacitor 42 connects between node B and ground. A second transistor 34 has a drain connected to a RF output and a source connected to ground. A current setting resistor 36 interposes power and node B. A first inductor 38 interposes node B and a RF input. A second inductor 40 connects between the gate of the second transistor 34 and the RF input. A third inductor 44 interposes power and the RF output. A second capacitor 46 interposes power and ground.

The first and second transistors 32, 36 are formed on a unitary substrate. The current setting resistor 36 may be integrated onto the unitary substrate.

In both embodiments, the current mirror voltage is sampled by an off-chip inductor 24, 44. This inductor can be part of the typical matching network required by the amplifier. The only extra component required is a package pin to get this node outside. If an external current setting resistor Rcs is desirable, then this extra pin is already required and can be used for both functions.

In both embodiments, the first and second transistors are preferably enhancement mode field effect transistors.

I claim:

1. A circuit comprising:

a first transistor having a drain and gate connected at a first node and a source connected to ground;

a current-setting resistor interposing the first node and an RF output;

a first capacitor interposing the first node and ground;

a first inductor interposing an RF input and the first node;

a second transistor having a gate, a drain connected to the RF output, and a source connected to ground;

a second inductor interposing the gate of the second transistor and the RF input;

a third inductor interposing power and the RF output;

a second capacitor interposing power and ground; and a substrate, wherein the first and second transistors are integrated into the substrate.

2. A circuit, as defined in claim 1, wherein the first and second transistors are enhancement mode field effect transistors.

3. A circuit comprising:

a first transistor having a drain and gate connected at a first node and a source connected to ground;

a first capacitor interposing the first node and ground;

a second transistor having a drain connected to a RF output, a source connected to ground, and a gate;

a current setting resistor interposing power and the first node;

a first inductor interposing the first node and a RF input;

a second inductor interposing the gate of the second transistor and the RF input;

a third inductor interposing power and the RF output;

a second capacitor interposing power and ground; and a substrate, wherein the first and second transistors are integrated on the substrate.

4. A circuit, as defined in claim 3, wherein the first and second transistors are enhancement mode field effect transistors.

* * * * *